United States Patent [19]

Liebman

[11] 4,407,925

[45] Oct. 4, 1983

[54] PROCESS FOR DEVELOPING ELECTROSTATIC IMAGES WITH MAGNETIC TONER

[75] Inventor: Alan J. Liebman, Skokie, Ill.

[73] Assignee: Xerox Corporation, Stamford, Conn.

[21] Appl. No.: 243,393

[22] Filed: Mar. 13, 1981

[51] Int. Cl.[3] ..... G03G 13/09

[52] U.S. Cl. ..... 430/122; 430/107; 430/106.6; 118/657

[58] Field of Search ..... 430/122, 107, 106.6

[56] References Cited

U.S. PATENT DOCUMENTS

| | | | |
|---|---|---|---|
| 3,262,806 | 7/1966 | Gourge' | 430/106.6 |
| 3,345,294 | 10/1967 | Cooper | 430/122 |
| 3,906,121 | 9/1975 | Fraser et al. | 430/122 |
| 4,176,078 | 11/1979 | Lu | 430/109 |
| 4,187,330 | 2/1980 | Harada et al. | 430/103 |
| 4,192,902 | 3/1980 | Lu | 427/107 |
| 4,198,477 | 4/1980 | Williams et al. | 430/120 |

FOREIGN PATENT DOCUMENTS 1412350 11/1975 United Kingdom .

*Primary Examiner*—John D. Welsh

*Attorney, Agent, or Firm*—Peter H. Kondo; Eugene O. Palazzo; John E. Beck

[57] ABSTRACT

This invention is directed to a process for charging magnetic toner particles contained in a xerographic developer composition, the developer composition being comprised of conductive magnetic carrier particles and substantially uncharged magnetic toner particles, said process comprising transporting by an electrode transporting member the magnetic toner particles into close proximity of the electrical potential existing in the region of an imaging bearing member of an electrophotographic, or electrographic imaging system containing a magnetic brush development device whereby charge of a polarity opposite to that of the electrical potential is induced into the toner particles, causing the toner particles to possess a resistivity of from about greater than $10^{15}$ ohms-cm to about less than about $10^{18}$ ohms-cm, the effective distance between said image bearing member and said electrode transporting member being from about 5 micrometers to about 100 micrometers. Developers containing such toner materials can be used to develop images in electrophotographic, or electrographic imaging systems.

13 Claims, No Drawings

PROCESS FOR DEVELOPING ELECTROSTATIC IMAGES WITH MAGNETIC TONER

BACKGROUND OF THE INVENTION

This invention relates generally to a process for charging magnetic toner compositions, and more specifically to a process for inductively charging magnetic toner compositions which charge is dependent on the polarity and magnitude of the development field rather than on the nature of the compositions used in the developer mixture, and the triboelectric properties of the carrier and toner employed.

The formation and development of electrophotographic images, and more specifically xerographic images is well known in the art as described for example in U.S. Pat. No. 2,297,691. In one common technique of development, carrier materials and fine insulating toner powder particles are cascaded over the electric potential pattern bearing member. The powder is triboelectrically charged to a certain polarity and magnitude and deposits preferentially in regions of the member surface where there is a preponderence of charge of opposite polarity. Generally, the triboelectric charge is caused by the presence of carrier beads in the developer mix. In another form of development known as magnetic brush development, magnetic carriers are employed, reference U.S. Pat. No. 3,641,980. In this method magnetic forces are employed for the purpose of causing the toner to deposit on the imaging member. In comparison to cascade development, magnetic brush development fills in solid areas better, is more compact, and does not depend on gravity to present the toner to the surface, a factor which allows freedom in locating the developer station. Cascade development is described in U.S. Pat. No. 2,618,552, while magnetic brush development is described, for example in U.S. Pat. Nos. 3,641,980, 2,874,063, 3,251,706 and 3,357,402. Other development methods include powder cloud development, as described in U.S. Pat. No. 2,221,776, and touchdown development, as described in U.S. Pat. No. 3,166,432. In the '432 patent there is described the use of a conductive one component developer (toner and no carrier particles) for developing electrostatic charge patterns by bringing a conductive support member bearing a layer of fine conductive toner particles into contact with the charge pattern bearing member. In this method the toner is held to the support member primarily by Van der Waals forces, and the conductive support member is held at a bias potential during development. This technique is apparently well suited for filling solid areas, and as an additional advantage requires only one component in the developer material.

In the conventional cascade development technique the toner carrier combination or developer has a definite charge polarity, and triboelectric relationship. Positive and negatively charged images cannot easily be made visible with the same developer, and further the images provided from such developers can be hollow in that solid areas are not filled, resulting in low development quality. The triboelectric properties of the toner while necessary to development can cause problems, for example, uneven charging of the toners causes background deposits as the uneven forces between carrier and toner result in varying threshold levels from toner particles to toner particles. Further since the toner retains its charge for long periods of time, any toner that escapes the development zone and enters into other parts of the apparatus can cause mechanical problems. Magnetic brush development, while it overcomes some of the problems encountered in cascade development, is in some instances less efficient in that it still required triboelectric toners which have the concomitant problems mentioned above. Further because of the mechanical brushing action and other electrical characteristics magnetic brush development can results in high background deposition and poor machine latitude.

There has also been described in the prior art magnetic development materials and systems wherein carriers are not utilized, that is, a one component type system. One such system is described in Wilson U.S. Pat. No. 2,846,333 which discloses the use of a magnetic brush to apply toner particles formed of magnetites and resin materials to develop electrostatic latent images. One difficulty encountered with this process is that the relatively high electrical conductivity of the toner renders electrostatic transfer rather difficult. Also, as described in U.S. Pat. No. 3,909,258, electrostatic development is accomplished by utilizing a magnetic brush without carrier, the particular toner employed being the toner of U.S. Pat. No. 3,639,245 which is a dry toner particle having specific electric conductivity.

While all of the above methods have certain advantages in particular situations, each has some disadvantages which have an adverse effect on their utility in development systems. Also in conventional magnetic brush systems wherein two component materials are used, that is, toner and carrier, the charge present on the toner is dependent upon the triboelectric relationship between the toner and carrier particles. Further there have been encountered in magnetic brush systems problems with regard to maintaining over a period of time sufficient adhesion between carrier and toner. In an aged developer, that is, for example, one that has been used in a xerographic imaging device for causing the development of images, toner separation occurs prematurely which causes the quality of the image being developed to be much lower than when the developer material was fresh. Also, the triboelectric charging characteristics of the developer are reduced, that is, the overall charge in microcoulombs per gram contained on the toner particles as the developer ages is less than it should be, thereby adversely affecting copy quality.

SUMMARY OF THE INVENTION

It is an object of this invention to provide processes for overcoming the above-noted disadvantages.

Another object of the present invention is the provision of processes that provide charges to toners used in magnetic brush development systems, thus allowing the production of clear sharp images.

It is a further object of this invention to provide a method whereby the charge on the toner is field induced, rather than being totally dependent on the triboelectric properties of the materials used.

A further object of the present invention is the provision of a method whereby the charge imparted to the toner particles is positive.

Also another object of the present invention is the provision of a method wherein the charge imparted to the toner particles is negative.

A further object of the present invention is a method for allowing the excellent adhesion of toner to carrier by employing magnetic attraction between the toner and the carrier.

An additional object of the present invention is the provision of a process where the development rate is high, up to 25 inches per second, while utilizing a single development roll.

These and other objects of the present invention are accomplished by the provision of a development method employing a conductive carrier material, and a magnetic toner material, resin plus magnetic pigments, and a coloring agent added thereto, as an optional ingredient, wherein the toner charging polarity and magnitude is controlled and determined by the polarity and magnitude of the development field. Thus, the toner charge is field induced and is not strongly dependent on the triboelectric relationship of the carrier and toner. Also there is provided a method whereby the adhesion of toner to carrier is very substantial, as indicated hereinafter. More specifically, the present invention is directed to a process for charging magnetic toner particles contained in a developer composition, comprised of conductive magnetic carrier particles, and substantially uncharged magnetic toner particles, said process comprising transporting by an electrode transporting member, the magnetic toner particles into close proximity of the electrical potential existing in the region of an image bearing member of an electrophotographic or electrographic imaging system containing a magnetic brush development device, whereby charge of a polarity opposite to that of the electrical potential is induced into the toner particles, causing the toner particles to possess a resistivity of from about greater than $10^{15}$ ohm-cm to about less than $10^{18}$ ohm-cm, the effective distance between said image bearing member and the electrode transporting member being from about 5 micrometers to about 100 micrometers. Developers containing such toner materials can be used for example to develop images in electrophotographic or electrographic imaging systems.

The charge polarity, that is, positive or negative, and the charge magnitude, that is, level of charge on the toner particles is achieved from the electrical potential that exists in the region of the image member. This potential, together with the presence of conductive carrier particles causes the induction of charges into the toner material. Therefore, when the potential is positive, negative charges will be induced into the toner, while when the potential is negative, positive charges will be induced into the toner particles. Accordingly, thus there is no need to introduce other materials such as charge control agents into the system in order to change the polarity of the toner, for example, when the toner has to be charged positively in order to develop negative latent electrostatic images, such as is accomplished for example when organic photoconductors are utilized in a xerographic imaging system. Further, developer composition charged in accordance with the present invention can be used to develop either positively charged images or negatively charged images.

A mechanism of adhesion between carrier and toner is necessary in order to prevent adverse problems as mentioned hereinbefore including developer dusting during transport. In conventional systems, that is, using toners and carriers that are triboelectrically charged the most significant contribution to adhesion between carrier and toner has been electrostatic charge. In the method of the present invention a non-electrostatic mechanism such as magnetic attraction betweein toner and carrier is employed to accomplish this adhesion. The magnetic attraction between the toner particles and carrier particles in the development zone also controls the threshold for development. By threshold is meant the development potential at which development begins, about 100 to 150 volts. In one embodiment, for example, powdered magnetic material such as magnetite included in the toner polymer during fabrication of the toner enters into the magnetic field regions of the magnetic brush developer and becomes temporarily magnetized. This toner adheres to the magnetic carrier particles not because of triboelectric charges but because of the magnetic fields induced on the carrier by externally applied fields, for example, the magnets under the sleeve of the brush roller in a magentic brush system. When the developer particles, that is, the toner and carrier leave the magnetic field, a residual magnetization of the toner particle causes adhesion to the carrier. This magnetization is renewed when the developer particles periodically re-enter the magnetic field, in the image development zone. This mechanism replaces the electrostatic adhesion mechanism presently used in tribo controlled magnetic brush developers. The magnetite or other similar equivalent material enables toner transport between the developer sump and the development zone. If the form of magnetite used in the toner has too low a magnetic remanence then severe toner concentration depletion can occur in the development zone. Additionally, the magnetic forces on the magnetic toner in the development zone help restrain background development. The magnetite also serves to enhance charge injection although as mentioned hereinbefore other magnetic loading materials or non-magnetic materials in addition to the magnetic might also be used to enhance such injection.

The amount of charge induced into the toner particles depends primarily on the magnitude of the development potential. Thus, when the magnitude of the development potential is between about −300 volts and about −700 volts, or the potential at which air breakdown is initiated, the amount of charge induced into the toner material varies from about +16 microcoulombs per gram to about +20 microcoulombs per gram, while when the development potential is between about 300 volts to about 700 volts, the amount of charge induced into the toner particles range from about −16 microcoulombs per gram to about −20 microcoulombs per gram. When a charge on the toner ranging between about −10 microcoulombs per gram to about −14 microcoulombs per gram is desired, the development potential is between about 200 volts to about 500 volts.

In order for the charge to be properly induced into the toner material, it is important that the toner be brought in close proximity, that is, at an effective distance from the imaging surface member such as the photoresponsive member used in the imaging system in order to cause a charge of the desired magnitude and polarity to be imparted to the toner particles. In one embodiment of the present invention, by close proximity is meant that the effective distance, not actual distance, between the photoreceptor member and the electrode transporting developer material ranges from about 5 to about 100 micrometers and preferably from about 10 to about 30 micrometers. If the developer material is at too great a distance from the photoreceptor surface and the field generated is too weak, it will be difficult to obtain the desired magnitude and change polarity on the toner particles. Distances outside these ranges can be employed as long as such distances do not adversely affect the amount of charge nor the sign of the charge that is imparted to the toner particles.

In the process of the present invention the electrical potential of the development roller is essentially maintained throughout the developer brush because of the developers conductivity. In particular the outermost carried bead particles are essentially at the same electric potential as the development roller surface. Accordingly, the effective distance between the photoreceptor member and the development electrode referred to herein corresponds to the thickness of the toner particle layer on the outermost carrier beads of the magnetic brush. The electric potential changes rapidly in this effective distance from the development roller potential to the photoreceptor surface potential.

A conductive magnetic carrier material is used with the toner for the primary purpose of transporting the uncharged toner into close proximity of the image bearing area in order that charge may be injected onto the toner. The toner particles being transported do not contain any substantial amount of charge thereon, for example, from about 1 to about 2 microcoulombs per gram. There is then induced from the latent image field either a negative charge or a positive charge whereby the toner acquires an opposite charge to the latent image field of the charge being induced. Therefore, the toner particles can either be charged negatively or positively. For example, systems are now known wherein the photoreceptor is charged negatively thereby requiring a positively charged toner. Such toners generally contain charge control agents for the purpose of imparting the required charge, and the charge control agent can in some instances cause problems to the charging mechanism as well as creating other adverse effects including effecting the copy quality of any images to be developed. With the method of the present invention, special toners do not have to be formulated in that the charge imparted to the toner depends on the charge present on the photoresponsive member. Thus, for example, if a negative charge is present on the photoreceptor, it will induce a positive charge into the toner and subsequently therefore the toner can be attracted to the image area and cause development of the resulting image.

The development potential, that is, the potential present at the photoresponsive surface may depend in some instances on the thickness of the photoreceptor. For example, a photoreceptor having a thickness of about 25 microns will usually require a development potential of about 600 volts in order to allow proper development, and induction of the appropriate magnitude of charge into the toner material. When the photoreceptor thickness is approximately 30 microns, the development potential on the photoreceptor is about 700 volts.

The charge on the toner is tribo independent, that is, it does not depend on rubbing charge exchange of toner and carrier particles, rather charging occurs by an inductive process from the development zone as mentioned hereinbefore. When the toner encounters a high field it charges, and immediately develops onto the imaging member or photoreceptor.

Many advantages are associated with eliminating the requirement of triboelectric charging including for example, development is free from environmental changes, mixing of carrier and developer is of less importance and ambipolar development is possible (that is, both negative and positive images can be developed with the same material). Also with the process of the present invention, either an inorganic photoreceptor material such as a selenium or selenium alloy or organic photoreceptor materials can be employed, and also there is eliminated the sensitivity for the tribo relationship which implies increased materials fabrication latitude with respect to the choice of resins that may be employed in the toner.

In one of the embodiments of this invention, the uncharged toner is magnetically loaded, that is, it contains a high percentage of a magentic material such as magnitude, up to 50 percent, in order that the uncharged toner can be transported through the development zone, under magnetic control. This allows for better transport and further helps control background suppression. That is, toner containing magnetic material is bound to magnetic carrier beads in the presence of the development rollers magnetic field. This magnetic bonding in the development zone provides a threshold counterforce to the non-image area forces that might otherwise attract background or unwanted particles to the photoconductive film. Only stronger image-area electric forces can then attract toner particles from the magnetic brush powder layer.

Numerous different types of toner resins and conductive carrier particles can be utilized in the practice of the present invention. A preferred type of toner is one comprised of a magnetically attractable material and an resin, wherein the magnetically attractable particles can contain a thin coating of a material compatible with the toner resin. Also, such particles have a strong affinity for the magnetite surface, and are compatible with the solvents used in toner formation. Typical resins that may be employed include polyamides, polyurethanes, epoxy, vinyl resins and polymeric esterification products of a dicarboxylic acid and a diol comprising a diphenol. Any suitable vinyl resin may be employed in the toners of the present system including homopolymers or copolymers of two or more vinyl monomers. Typical of such vinyl monomeric units include: styrene; vinyl naphthalene; ethylenically unsaturated mono-olefins such as ethylene, propylene, butylene, isobutylene and the like; vinyl ester such as vinyl chloride, vinyl bromide, vinyl fluoride, vinyl acetate, vinyl propionate, vinyl benzoate, vinyl butyrate and the like; esters of alpha-methylene aliphatic monocarboxylic acids such as methyl acrylate ethyl acrylate, n-butylacrylate, isobutyl acrylate, dodecyl acrylate, n-octyl acrylate, 2-chloroethyl acrylate, phenyl acrylate methyl-alpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone, methyl isopropenyl ketone and the like; vinylidene halides such as vinylidene chloride, vinylidene chlorofluoride and the like; and N-vinyl compounds such as N-vinyl pyrrol, N-vinyl carbazole, N-vinyl indole, N-vinyl pyrrolidene and the like; and mixtures thereof.

It is generally found that toner resins containing a relatively high percentage of styrene are preferred since greater image definition and density is obtained with their use. The styrene resin employed may be a homopolymer of styrene or styrene homologs or copolymers of styrene with other monomeric groups containing a single methylene group attached to a carbon atom by a double bond. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization techniques such as free radical, anionic and cationic polymerization processes. Any of these vinyl resins may be blended with one or more other resins if desired, preferably other vinyl resins which insure good resistance against physical degradation. However, non-vinyl type thermoplastic resins may also be employed including resin modified phenolformaldehyde resins, oil modified epoxy resins, polyurethane resins, cellulosic resins, polyether resins and mixtures thereof. Also useful as toner resins include those materials that are the polymeric esterification products of a dicarboxylic acid and a diol comprising a diphenol as described in U.S. Pat. No. 3,590,000, the teachings of which are totally incorporated herein by reference and in particularly the diphenol reactant material, the formula of which is described in column 2 of the U.S. Pat. No. 3,590,000. While any suitable dicarboxylic acid may be reacted with the diol, those of the general formula $HOOC—R'''_{n3}COOH$ as described in the U.S. Pat. No. 3,590,000 are preferred.

Optimum electrophotographic results are achieved with styrene butyl methacrylate copolymers, styrene-vinyl toluene copolymers, styrene acrylate copolymers, polystyrene resins, predominately styrene or polystyrene based resins as generally described in U.S. Pat. No. Re. 25,136 and polystyrene blends as described in U.S. Pat. No. 2,788,288.

The toner resin may also contain a colorant such as carbon black, present in amounts of from 20 to about 70 percent by weight and preferably 30 to 50 percent by weight, while the resin is present in amounts of from about 30 to 80 percent by weight, and preferably 50 to 70 percent by weight. Other suitable colorants can be used in addition to those mentioned such as for example nigrosine dye, aniline blue, calco oil blue, chrome yellow, ultra marine blue, DuPont oil red, ethylene blue chloride, phthalocyanine blue, iron oxides such as Mapico black, Mapico reds, yellows, browns, tans, and mixtures thereof.

Magnetic toners are essential to the process of the present invention, that is, toners that are attracted to a magnet but are not magnets themselves, as this is the mechanism used for adhesion between toner and carrier particles; both toner and carrier particles are thus magnetic. The magnetic developer is held to a magnetic brush roller or belt by magnetic forces and the magnetic brush is electrically biased to induce a charge opposite to that carried by the photoreceptor, into the toner particles. Subsequently the outer toner particles develop the electrostatic image as the electrostatic forces overcome the magnetic forces to deposit toner in the image areas. Magnetic pigments are utilized with the toners of the present invention in one preferred embodiment such magnetic pigments including preferably magnetites as indicated herein, ferrites, iron particles, and nickel alloys. The magnetite particles may be of any shape and any size, subject to the provision that they are smaller in diameter than the toner particles which results in semiconductive toner particles with good transfer properties. Generally, however, average particle sizes between about 0.02 microns and about 1 micron with a preferred size of between about 0.1 to about 0.5 microns are employed. The magnetic particles themselves can be acicular or cubical in shape.

The toners generally have a resistivity that is dependent on the strength of the electric field, that is, they are conductive during high fields of development and have a powder resistivity of greater than $10^{15}$ ohm-cm but less than $10^{18}$ ohm-cm at low fields. The preferred toner is conductive at high fields so as to be easily developed by inductive techniques for example, and in such a situation, these toners have a preferred resistivity of greater than $10^{16}$ ohm-cm and a resistivity of less than $10^{18}$ ohm-cm at a field of about 10 volts/cm, however, at high fields such as about 30 kilovolts/cm the resistivity should be about $10^{9}$ ohm-cm. It is preferred that a high resistivity of greater than $10^{12}$ ohm/cm be maintained at least up to about 1,000 volts/cm field strength in order to result in greater transfer latitudes. The preferred initial resistivity of the toner is greater than $10^{16}$ ohm-cm as this range allows good transfer of the electrostatic image.

Any method of toner particle formation may be utilized in the prevent invention which results in toner of the desired properties. Typical of such methods are hot melt formation and mastication followed by attrition to the desired toner particle size. One preferred method of preparing magnetic toners involving forming a solvent dispersion of the magnetite and toner resin and spray drying the dispersion, as this results in toner particles having the magnetite concentrated at the surface and results in toner of good magnetic and electrostatic properties for excellent magnetic induction development and electrostatic transfer to plain paper.

The solvent used for spray drying may be any material capable of dissolving the toner resin without adversely effecting the coating of the magnetite. Solvents for toner resins are well known including hydrocarbons, alcohols, ketones, esters, amides, fluorinated hydrocarbons, chlorinated hydrocarbons and other well known solvents. Preferred solvents are toluene for use with styrene polymer resins and styrene polymer blends as this results in a toner that is solvent free and the solvent is low cost and relatively nontoxic. Chloroform has been found to be a preferred solvent for use with polyester type toner resins as it is readily available, non-flammable and results in a toner of low residual solvent. Both chloroform and toluene also are compatible with the preferred fatty acid and derivative coatings for the magnetite. The solvent is generally used in an amount such that the solids content of the solvent slurry is 5 to 20 percent by weight. The term solids content is used herein to indicate the solid resulting from spray during which is the resin and magnetite plus any other additives to the toner such as colorants.

While numerous suitable conductive magnetic carrier may be used in the process of the present invention, there is preferred a gritty-type material which is characterized by having randomly spaced and rigid asperities on the surface so that electrical contact is more or less assured between carrier particles for a large range of toner concentrations. The carrier material can either be coated, partially coated or uncoated depending on the image characteristics desired as well as other factors. When the carrier is coated there can be employed a conductive or partially conductive coating consisting essentially of a metallic material such as iron. The carrier with or without a coating allows the electrical conduction between the sleeve of the brush and the outer most developer particle. Thus for the development of lines charge injection has to occur in a relatively short time dependent on the development zone geometry and process speed parameters. Illustrative examples of carrier materials include steel, nickel, iron, magnetically active ceramic materials and nickel berry carriers. These carriers can be coated or partially coated with conductive materials such as polymers containing carbon black, or deposited salts and the like. The carrier particles may be employed with the toner composition in any suitable combination however generally satisfactory results have been obtained when from about 1 part toner is used with about 10 to about 200 parts by weight of carrier depending on the specific gravity of the carrier particles.

The following examples are being supplied to further define the specifics of the present invention, it being noted that these examples are intended to illustrate and not limit the scope of the invention. Parts and percentages are by weight unless otherwise indicated.

EXAMPLE I

There was prepared a toner resin by melt blending followed by mechanical attrition of a resin containing 50 percent by weight of styrene/n-butyl methacrylate copolymer, (65 percent by weight of styrene, 35 percent by weight of n-butyl methacrylate), and 50 percent by weight of a magnetic material commercially available as magnetite MO-4431, from Cities Service. To 1 part by weight of the toner resin there was added 10 parts by weight of an uncoated Hoeganaes core sponge conductive carrier. The resulting developer which has essentially no triboelectric charge contained thereon is placed within 0.2 centimeters of a photoreceptor which has negative charges contained thereon, the potential being approximately −700 volts. After a short period of time there was injected or induced into the toner a positive charge having a value of 20 microcoulombs per gram. The toner of this Example had a resistivity of $3.3 \cdot 10^{16}$ ohm-cm at electric fields of up to 50,000 volts/cm.

The above toner was also charged by a photoreceptor having a positive charge thereon of +700 volts thereby introducing a negative charge of −20 microcoulombs per gram into the toner.

EXAMPLE II

The procedure of Example I was repeated. The following graph indicates the amount of toner that deposited on the photoreceptor surface for the development potential shown. The toner coverage is represented by (m/a) (mass per unit area in milligrams per centimeter squared).

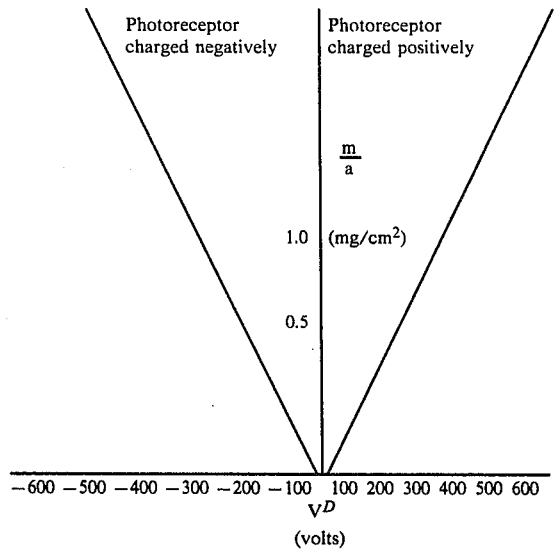

As noted from the above-identified graph, substantial amounts of toner can be developed from a single developer material with either polarity charge + or − on a photoreceptor. This demonstrates that the toner can either be charged positively or negatively depending on the sign of the charge on the photoreceptor. When this developer was used in a xerographic imaging system wherein the photoreceptor was charged positively, prints of excellent resolution and quality were obtained. Also when this developer was used in a xerographic imaging system wherein the photoreceptor was charged negatively, prints of excellent resolution and quality were obtained.

EXAMPLE III

The procedure of Example I was repeated with the exception that the toner resin used was comprised of 50 percent by weight of a polyester resin (propoxylated Bisphenol A) and a conductive carrier comprised of a steel core containing a polyvinylidene fluoride overcoating. The toner developed on the photoreceptor charged positively to 16 microcoulombs per gram when the photoreceptor had a potential of −300 volts.

This developer (toner plus carrier) when used in a xerographic imaging system produced images of excellent quality and excellent resolution with good solid area coverage. The toner of this Example had a resistivity of 2·10 16 ohm-cm at electrical fields of up to 10,000 volts/cm, which resistivity dropped at higher fields, thus at 25,000 volts/cm, the resistivity was $10^{14}$ ohm-cm.

EXAMPLE IV

A toner powder was prepared by attrition of a resin comprised of 50 percent by weight of styrene/n-butylmethacrylate copolymer (58 percent by weight styrene and 42 percent n-butylmethacrylate) and 50 percentby weight of a finely divided magnetite available as K378 from Northern Pigments, Inc. The resistivity of this toner was $1 \times 10^{17}$ ohm-cm up to 30,000 volts/cm. A carrier bead powder was prepared by coating a gritty steel powder with 3 percent by weight of polyvinylidene fluoride resin and treating the resultant powder with 1 percent Zonyl FSA surfactant (available from Allied Chemical Co.). The carrier powder was sieved to the range of 80/150 mesh. A developer composition was prepared by adding the above toner, at a 3 percent weight concentration, to the above carrier powder; and the mixture was found to have a tribo value of −3 microcoulombs/gram prior to use in a magnetic brush imaging system.

This developer mixture was placed in a one-roller magnetic brush unit having a roller surface speed of 25 inches/second. When an imaged photoreceptor travelling at a surface speed of 25 inches/second in an opposing direction to the brush roller was developed by the magnetic brush unit, prints of high image density and low background were obtained. These conditions correspond to a rate of development that is three to six times higher than that achieved by the same one-roller brush containing conventional tribo-charging developer. The toner developed on the photoreceptor was found to have a tribo of up to −16 microcoulombs/-gram. Background area particle counts were made of the toner on the photoreceptor plate; only two particles/mm$^2$ were counted for the magnetic toner material versus forty particles/mm$^2$ for a conventional tribo-charging developer using non-magnetic toner. The inductive-charging, magnetic-toner developer was capable therefore of providing black image areas and low background area dirt levels at high photoreceptor development rates.

The photoreceptor employed in the above Examples contains an aluminized Mylar substrate, overcoated with a trigonal selenium-polyvinyl carbazole generating layer, which in turn is overcoated with a transport layer of N,N′-diphenyl-N,N′-bis(chloro phenyl)-[1,1′-biphenyl]-4,4′-diamine dispersed in polycarbonate, when a negative charging mode is employed, and selenium when a positive charging mode is employed.

Other modifications of the present invention will occur to those skilled in the art upon a reading of the present invention. These are intended to be included within the scope of this invention.

What is claimed is:

1. A method of developing electrostatic latent images comprising providing a developer composition comprising substantially uncharged magnetic toner particles having a resistivity greater than about $10^{16}$ ohm-cm and less than about $10^{18}$ ohm-cm at an electric field of about 10 volts/cm and a resistivity greater than about $10^{12}$ ohm-cm at an electric field of about 1,000 volts/cm magnetically bound by an induced magnetic field to conductive magnetic carrier particles, providing a magnetic brush member having magnetic fields which temporarily magnetize said magnetic toner particles, magnetically transporting said developer composition on said magnetic brush member into and through a development zone between an electrostatic latent image bearing member and said magnetic brush member, maintaining the thickness of the toner particle layer on the outermost carrier particles on said magnetic brush member in said development zone between about 5 micrometers and about 100 micrometers, and maintaining the potential of said electrostatic latent image in said development zone at a level sufficient to induce an opposite charge in toner particles in said toner particle layer in said development zone and to overcome the magnetic attraction between the magnetic toner particles and the magnetic carrier particles whereby toner particles are attracted from carrier particles in said development zone to said electrostatic latent image.

2. A method according to claim 1 wherein the charge induced in the toner particles in said development zone is a positive charge.

3. A method according to claim 1 wherein the charge induced in the toner particles in said development zone is a negative charge.

4. A method according to claim 2 wherein the potential present at the surface of said image bearing member is up to −700 volts and the potential at which air breakdown is initiated.

5. A method according to claim 3 wherein the potential present at the surface of said imagine bearing member is up to 700 volts and the potential at which air breakdown is initiated.

6. A method according to claim 4 wherein the maximum charge induced into the toner material ranges from about 16 microcoulombs per gram to about 20 microcoulombs per gram.

7. A method according to claim 5 wherein the maximum charge induced into the toner material ranges from about −16 microcoulombs per gram to about −20 microcoulombs per gram.

8. A method according to claim 1 wherein the magnetic attraction between said uncharged magnetic toner particles and conductive magnetic carrier particles is greater than the electrostatic attraction between non-image areas of said electrostatic latent image bearing member and the toner particles.

9. A method according to claim 1 wherein said toner particles comprise copolymer resin of styrene and n-butyl methacrylate or a polyester resin and magnetic component.

10. A method according to claim 9 wherein said magnetic component is magnetite present in an amount from about 20 percent to about 70 percent by weight and the resin is present in amount of from about 30 percent to about 80 percent by weight.

11. A method according with claim 1 wherein said conductive carrier particles are selected from the group consisting of steel cores, steel cores partially coated with a coating material and steel cores coated with a conductive or partially conductive coating material.

12. A method according to claim 11 wherein said coating material comprises polyvinylidene fluoride polymer.

13. A method according to claim 1 including transferring the toner particles attracted from said carrier particles in said development zone to said electrostatic latent image to a receiving member and fixing the transferred toner particles permanently to said receiving member.

* * * * *